US008845300B2

(12) United States Patent
Renner

(10) Patent No.: US 8,845,300 B2
(45) Date of Patent: Sep. 30, 2014

(54) COMPRESSOR FREEZE UP PREVENTION IN COLD WEATHER

(75) Inventor: Ross Renner, Black Creek, WI (US)

(73) Assignee: Illinois Tool Works Inc., Glenview, IL (US)

( * ) Notice: Subject to any disclaimer, the term of this patent is extended or adjusted under 35 U.S.C. 154(b) by 494 days.

(21) Appl. No.: 12/782,665

(22) Filed: May 18, 2010

(65) Prior Publication Data

US 2010/0316505 A1 Dec. 16, 2010

Related U.S. Application Data

(60) Provisional application No. 61/186,120, filed on Jun. 11, 2009.

(51) Int. Cl.

| | |
|---|---|
| ***F04B 49/22*** | (2006.01) |
| ***F04B 53/08*** | (2006.01) |
| ***F04B 49/03*** | (2006.01) |
| ***B66C 23/42*** | (2006.01) |
| ***F04B 39/06*** | (2006.01) |

(52) U.S. Cl.

CPC ..... *F04B 39/068* (2013.01); *F04B 53/08* (2013.01); *F04B 49/22* (2013.01); *F04B 49/03* (2013.01); *B66C 23/42* (2013.01)

USPC ..... 417/32; 417/53; 417/309

(58) Field of Classification Search

CPC ..... F04B 39/068

USPC ..... 417/53, 32, 309

See application file for complete search history.

(56) References Cited

U.S. PATENT DOCUMENTS

| | | | | |
|---|---|---|---|---|
| 2,172,882 | A | 9/1939 | Watkins | |
| 4,635,668 | A * | 1/1987 | Netter | 137/62 |
| 6,121,691 | A | 9/2000 | Renner | |
| 6,153,855 | A | 11/2000 | Renner et al. | |

(Continued)

FOREIGN PATENT DOCUMENTS

| | | |
|---|---|---|
| EP | 1138949 A2 | 10/2001 |
| JP | 62158938 | 7/1987 |

(Continued)

OTHER PUBLICATIONS

International Search Report for application No. PCT/US2010/037999 mailed Dec. 2, 2010.

(Continued)

*Primary Examiner* — Charles Freay
*Assistant Examiner* — Philip Stimpert
(74) *Attorney, Agent, or Firm* — Fletcher Yoder P.C.

(57) ABSTRACT

The present embodiments provide a control system and method that is able to automatically cycle one or more compressor valves, for example to prevent freeze up. For example, in one embodiment, a system includes a compressor having a compression device configured to increase a pressure of a gas, a valve configured to control flow of the gas from the compression device, and a controller configured to cycle the valve to reduce buildup of contaminants in the compressor.

19 Claims, 4 Drawing Sheets

(56) References Cited

U.S. PATENT DOCUMENTS

| | | | | |
|---|---|---|---|---|
| 6,394,758 | B1 | 5/2002 | Lee et al. | |
| 6,469,276 | B1 | 10/2002 | Renner et al. | |
| 6,603,213 | B1 | 8/2003 | Renner | |
| 6,812,584 | B2 | 11/2004 | Renner | |
| 6,812,585 | B2 | 11/2004 | Renner | |
| 2003/0035719 | A1* | 2/2003 | Wadia et al. | 415/145 |
| 2003/0222626 | A1 | 12/2003 | Renner | |
| 2004/0108728 | A1 | 6/2004 | Renner | |
| 2005/0111997 | A1 | 5/2005 | Smith et al. | |
| 2006/0067833 | A1* | 3/2006 | McAuliffe et al. | 417/43 |
| 2008/0122195 | A1* | 5/2008 | Beeson et al. | 280/151 |
| 2009/0194067 | A1 | 8/2009 | Peotter et al. | |

FOREIGN PATENT DOCUMENTS

| | | |
|---|---|---|
| JP | 3168376 | 7/1991 |
| JP | 10288427 | 10/1998 |
| WO | 2008067252 A2 | 6/2008 |

OTHER PUBLICATIONS

U.S. Appl. No. 12/367,400, filed Feb. 6, 2009.
U.S. Appl. No. 12/369,558, filed Feb. 11, 2009.
U.S. Appl. No. 12/369,569, filed Feb. 11, 2009.

* cited by examiner

COMPRESSOR FREEZE UP PREVENTION IN COLD WEATHER

CROSS REFERENCE TO RELATED APPLICATIONS

This application claims the benefit of U.S. Provisional Patent Application Ser. No. 61/186,120, entitled "COMPRESSOR FREEZE UP PREVENTION IN COLD WEATHER", filed on Jun. 11, 2009, which is herein incorporated by reference in its entirety.

BACKGROUND

The invention relates generally to a compressor and, more specifically, a freeze prevention system and method. A compressor may be sued in to variety of application and environmental conditions. Unfortunately, the compressor may be subject to ice formation and/or debris buildup, which can reduce the performance of the compressor. For example, ice may form within a valve of the compressor.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The present embodiments provide a control system and method that is able to automatically cycle one or more compressor valves, for example to prevent freeze up. For example, in one embodiment, a system includes a compressor having a compression device configured to increase a pressure of a gas, a valve configured to control flow of the gas from the compression device, and a controller configured to cycle the valve to reduce buildup of contaminants in the compressor.

In another embodiment, a system is provided having a compressor. The compressor includes a compression device configured to increase a pressure of a gas, a valve configured to control flow of the gas from the compression device, and a controller configured to cycle the valve at a plurality of set points after startup of the compressor to reduce buildup of ice in the compressor.

The present embodiments further provide a method including cycling a valve of a compressor at a plurality of set points after startup of the compressor to reduce buildup of ice in the compressor.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed below, embodiments of the present technique provide a uniquely effective solution to pressure management in compressors. Thus, the disclosed embodiments relate or deal with any application where a compressor is powered, such as by a CI or SI engine, and the load or combination of loads are intermittently applied to the engine. In certain embodiments, the disclosed pressure management techniques may be used with various service packs to prevent an over pressuring condition of a compressor. For example, the disclosed embodiments may be used in combination with any and all of the embodiments set forth in U.S. application Ser. No. 11/742,399, filed on Apr. 30, 2007, and entitled "ENGINE-DRIVEN AIR COMPRESSOR/GENERATOR LOAD PRIORITY CONTROL SYSTEM AND METHOD," which is hereby incorporated by reference in its entirety. By further example, the disclosed embodiments may be used in combination with any and all of the embodiments set forth in U.S. application Ser. No. 11/943,564, filed on Nov. 20, 2007, and entitled "AUXILIARY SERVICE PACK FOR A WORK VEHICLE," which is hereby incorporated by reference in its entirety.

As discussed below, the present embodiments utilize pressure sensing from the compressor, thereby providing feedback to a controller and/or user to prevent freeze-up and/or debris buildup in the compressor. For example, during cold weather, such as on a snowy or cold and rainy day, there may be an accumulation of ice internal to the compressor. A controller configured according to the present embodiments may cycle a solenoid-activated valve between an open and a closed position to loosen the ice that has accumulated inside the compressor. Additionally, it should be noted that if significant buildup is present, the cycling may not result in large movement of the valve (i.e., the valve may not be able to reach the fully open or fully closed positions). The cycling may be performed at a number of different set points, such as pressures, as described below. As an example, the controller may cycle the valve at pressures of 75, 85, and at 150 psi, which may also correspond to the amount of time that the compressor has been in operation since being turned on. It should be noted that the pressures at which the valve is cycled may be determined based upon manufacturing specifications, or may be user-defined.

Figure 1:
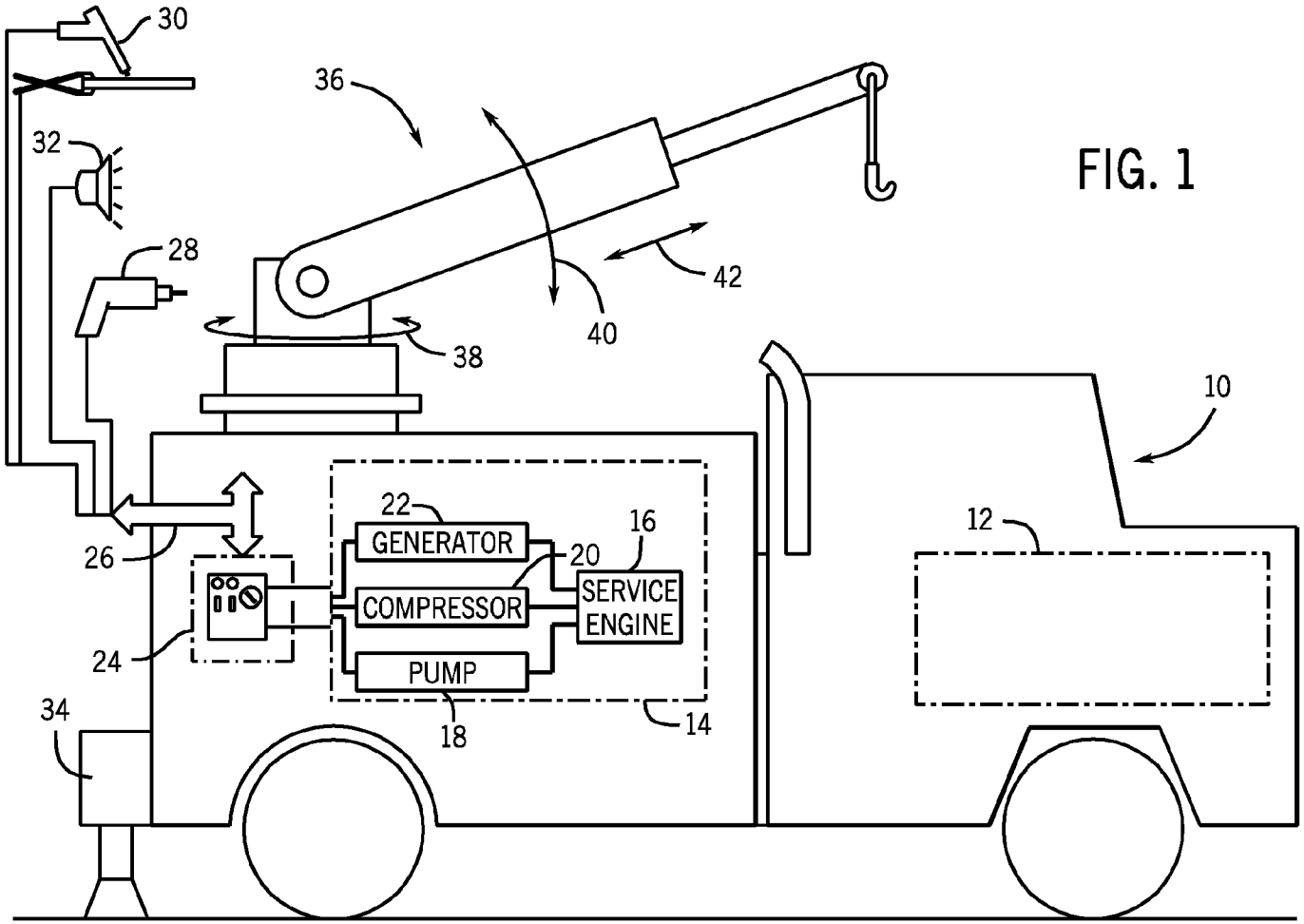
FIG. 1 is a diagrammatical overview of a work vehicle having a service pack with a compressor configured to perform valve cycling to prevent and/or breakup ice or debris buildup in accordance with aspects of the present embodiments is installed.

As noted above, the present embodiments of a control system that is configured to perform valve cycling in a compressor is applicable to a variety of implementations, including work vehicles. FIG. 1 illustrates a work vehicle 10 including a main vehicle engine 12 coupled to a service pack module 14. The service pack 14 includes equipment that is capable of providing resources such as electrical power, compressed air, and hydraulic power. The equipment may be powered with or without assistance from the main vehicle engine 12. For example, a service engine 16 may power the service pack 14. Thus, in some embodiments, the operator can shut off the main vehicle engine to reduce noise, conserve fuel, and increase the life of the main vehicle engine 12, as the service engine 16 is typically smaller and thus, consumes less fuel. As an example, the service pack engine 16 may include a spark ignition engine (e.g., gasoline fueled internal combustion engine) or a compression ignition engine (e.g., a diesel fueled engine), for example, an engine with 1-4 cylinders with approximately 10-80 horsepower.

The service pack 14 may have a variety of resources, such as electrical power, compressed air, hydraulic power, and so forth. In the illustrated embodiment, the service pack 14 includes a pump 18. In particular, the pump 18 may include a hydraulic pump, a water pump, a waste pump, a chemical pump, or any other fluid pump. According to present embodiments, the service pack 14 includes an air compressor 20 as well as a generator 22. The air compressor 20 and the generator 22 may be driven directly, or may be belt, gear, or chain driven, by the service engine 16 or one or more motors to which the service engine 16 and/or the pump 18 is coupled (e.g., a hydraulic motor). The generator 22 may include a three-phase brushless type, capable of producing power for a wide range of applications. However, other generators may be employed, including single phase generators and generators capable of producing multiple power outputs. The air compressor 20 may be of any suitable type, although a rotary screw air compressor is presently contemplated due to its superior output to size ratio. Other suitable air compressors might include reciprocating compressors, typically based upon one or more reciprocating pistons. It should be noted that the air compressor 20 contains one or more solenoid valves, such as a main control valve, that may be cycled at varying pressures to prevent or breakup ice or debris buildup.

The service pack 14 includes conduits, wiring, tubing, and so forth for conveying the services/resources (e.g., electrical power, compressed air, and fluid/hydraulic power) generated to an access panel 24. The access panel 24 may be located on any portion of the vehicle 10, or on multiple locations in the vehicle, and may be covered by doors or other protective structures. In one embodiment, all of the services may be routed to a single/common access panel 24. The access panel 24 may include various control inputs, indicators, displays, electrical outputs, pneumatic outputs, and so forth. In an embodiment, a user input may include a knob or button configured for a mode of operation, an output level or type, etc. According to the embodiments described herein, at least one controller is present in or operatively coupled to the access panel 24. The controller is able to cycle the main control valve of the air compressor 20 to prevent the compressor 20 from freezing up due to the presence of contaminants, such as ice, particulate matter, etc. In cycling the control valve, the controller may substantially reduce or eliminate possible compressor freeze up situations. The controller may control all or a part of the service pack 14, which, as noted above, supplies electrical power, compressed air, and fluid power (e.g., hydraulic power) to a range of applications designated generally by arrows 26.

As depicted, air tool 28, torch 30, and light 32 are applications connected to the access panel 24 and, thus, the resources/services provided by the service pack 14. The various tools may connect with the access panel 24 via electrical cables, gas (e.g., air) conduits, fluid (e.g., hydraulic) lines, and so forth. The air tool 28 may include a pneumatically driven wrench, drill, spray gun, or other types of air-based tools that receive compressed air from the access panel 24 and compressor 20 via a supply conduit (e.g., a flexible rubber hose). The torch 30 may utilize electrical power and compressed gas (e.g., air or inert shielding gas) depending on the particular type and configuration of the torch 30. For example, the torch 30 may include a welding torch, a cutting torch, a ground cable, and so forth. More specifically, the welding torch 30 may include a TIG (tungsten inert gas) torch or a MIG (metal inert gas) gun. The cutting torch 30 may include a plasma cutting torch and/or an induction heating circuit. Moreover, a welding wire feeder may receive electrical power from the access panel 24.

The fluid system of the service pack 14, such as the pump 18, hydraulically powers a vehicle stabilizer 34. The vehicle stabilizer 34 operates, for example, to stabilize the work vehicle 10 at a work site when heavy equipment is used. Such equipment may include a hydraulically powered crane 36 that may be rotated, raised and lowered, and extended (as indicated by arrows 38, 40 and 42, respectively). Again, the service pack 14 may provide the desired resources/services to run various tools and equipment without requiring operation of the main vehicle engine 12.

The vehicle 10 and/or the service pack 14 may include a variety of protective circuits for the electrical power, e.g., fuses, circuit breakers, and so forth, as well as valving for the hydraulic and air service. For the supply of electrical power, certain types of power may be conditioned (e.g., smoothed, filtered, etc.), and 12 volt power output may be provided by rectification, filtering and regulating of AC output. Valving for fluid (e.g., hydraulic) power output may include by way example, pressure relief valves, check valves, shut-off valves, as well as directional control valving. Moreover, the air compressor 26 may draw air from the environment through an air filter and the pump 16 may draw fluid from and return fluid to a fluid reservoir.

Depending upon the system components selected and the placement of the service pack 14, reservoirs may be provided for storing fluid (e.g., hydraulic fluid) and pressurized air as noted above. However, the fluid reservoir may be placed at various locations or even integrated into the service pack 14. Likewise, depending upon the air compressor selected, no reservoir may be used for compressed air. Specifically, if the air compressor 20 includes a non-reciprocating or rotary type compressor, then the system may be tankless with regard to the compressed air. In one embodiment, as noted above, the air compressor 20 may contain one or more valves (e.g., a main control valve) that are subject to freeze-up due to ice formation in cold conditions and/or debris buildup. In embodiments where ice buildup (or a similar contaminant) freezes the main control valve, the pressure within the air compressor 20 may cause a pressure relief valve to open, may cause the air compressor 20 to shut down, or, in some situations, may cause the service pack 14 to shut down altogether. As such, the present embodiments provide for the main control valve of the compressor 20 to be cycled to loosen, dislodge, or breakup ice and/or other contaminants.

In use, the service pack 14 provides various resources/services (e.g., electrical power, compressed air, fluid/hydraulic power, etc.) for the on-site applications completely independent of vehicle engine 12. For example, the service pack engine 16 generally may not be powered during transit of the vehicle from one service location to another, or from a service garage or facility to a service site. Once located at the service site, the vehicle 10 may be parked at a convenient location, and the main vehicle engine 12 may be shut down. The service pack engine 16 may then be powered to provide auxiliary service from one or more of the service systems described above. Where desired, clutches, gears, or other mechanical engagement devices may be provided for engagement and disengagement of one or more of the generator 22, the pump 18, and the air compressor 20.

Figure 2:
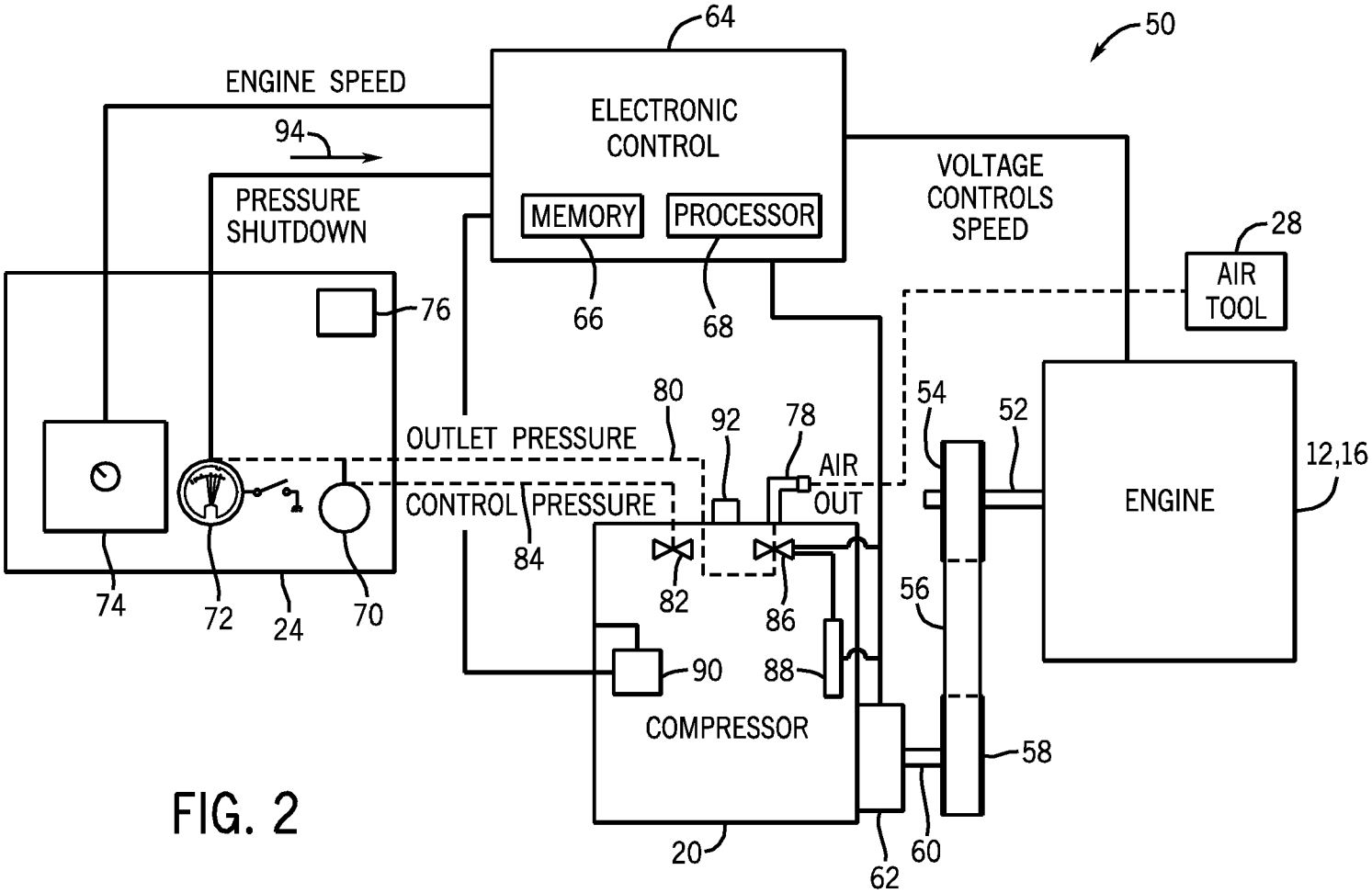
FIG. 2 is diagrammatical representation of a compression and control system that is configured to prevent and/or breakup ice or debris buildup in the compressor in accordance with present embodiments.

FIG. 2 is a block schematic illustrating an embodiment of a control and monitoring system 50 wherein pressure, flow, or other operation parameters of the air compressor 20 are controlled or regulated directly on the control panel 24. In the illustrated embodiment, the air compressor 20 is drivingly coupled to the engine 12 via a belt and pulley system including stub shaft 52, a pulley 54, a drive belt 56, a compressor pulley 58, and the compressor drive shaft 60. In the illustrated embodiment, the engine 12 rotates the stub shaft 52 to transmit rotation and torque via the pulleys 54 and 58 and drive belt 56 to the compressor drive shaft 60 coupled to the air compressor 20. Accordingly, the mechanical energy generated by the engine 12 operates the air compressor 20. Additionally, a clutch 62 is provided. The clutch 62 is generally configured to enable engagement and disengagement of the compressor 20 with the compressor pulley 58 and, in turn, the engine 12. For example, the clutch 62 may include an electromagnetic clutch, a wet clutch, or another suitable clutch configuration.

The system 50 includes control circuitry 64 having a processor 66 and memory 68, wherein the system 50 may be controlled or monitored by an operator through the control panel 24. In this embodiment, the control panel 24 includes a regulator 70, a pressure gauge 72, and one or more user inputs 74, which may be used to monitor, regulate, or generally control various features of the air compressor 20 as discussed in further detail below. For example, the regulator 70 enables tool-free control of the air pressure of the air compressor 20, obviating the need for special tools to perform such tasks. The ability to control pressure via the regulator 70 also substantially reduces or altogether eliminates the need for accessing internal components of the system 10 or other more time consuming tasks to adjust such operational parameters. Indeed, an operator may work in conjunction with the control circuitry 64 to perform cycling of one or more valves of the compressor 20, as discussed below. As an example, the user may adjust the pressure within the compressor 20 in a manner that provides finer control over pressurization rates, heating rates, and so forth, than would be available with normal operation of the compressor 20.

As an example, a user may desire to provide one or more sensors, such as a temperature sensor, in or around the compressor 20, as discussed below. The sensor may have respective monitoring and control circuitry, which the user may interface with the access panel 24 as the inputs 74. Generally, the inputs 74 may include one or more knobs, buttons, switches, keypads, or other devices configured to select an input or display function, as discussed further herein. The control panel 24 may include one or more display devices 76, such as an LCD display, to provide feedback to the operator. It should be noted that the control panel 24 is not limited to the components described herein, and may include any number of components as desired or required for monitor or control of the system 50, such as multiple user inputs, display devices, gauges, etc.

The air compressor 20 includes an outlet connection 78 for connection to air-operated devices, such as plasma cutters, impact wrenches, drills, spray guns, lifts, or other pneumatic-driven tools, such as those described above with respect to FIG. 1. Additionally, an outlet pressure line 80 is connected to the regulator 70 and the pressure gauge 72. An inlet valve 82 is located at the inlet of the air compressor 20. A control pressure line 84 is connected from the inlet valve 82 to the regulator 70 to provide for control of the pressure generated by the air compressor 20. A main control valve 86, such as a solenoid-driven valve, controls the amount of compressed (pressurized) gas that flows out of the compressor 20. In the present context, the regulator 70 may be manually and/or automatically adjusted to cycle the valve 86 at varying pressures to dislodge contaminants (e.g., ice, dirt, clay, and the like). For example, in situations where the valve 86 experiences a larger than average amount of contaminant buildup, the electronic control 64 may provide for the valve 86 to be cycled at different pressures, such as at three different pressures (e.g., between approximately 70 and 80 psi, 80 and 90 psi, and 120 and 160 psi). It should be noted that any number of cycles and pressures may be utilized to perform cycling, such that the number of cycles includes one or a plurality of cycles (e.g., 2, 3, 4, 5, 6, 7, 8, 9, 10 or more) and one or a plurality of pressures. Further, as the pressure at which the valve 86 is cycled increases, it should be noted that a greater amount of force may be applied to any contaminant buildup. In this way, a cycle at 150 psi applies more force than a cycle at 75 psi. Further, the amount of time at which the valve 82 is cycled may vary, such as between approximately 0.5 and 10 seconds (e.g., approximately 0.5, 1, 2, 3, 4, 5, 6, 7, 8, 9, or 10 seconds). Automatic and/or manual control of the valve 82 is described in further detail below.

In addition to cycling the valve 86 to prevent compressor freeze up, the compressor 20 may also provide a heating element 88 and a temperature sensor 90 for heating an area of the compressor in response to measured temperatures. For example, when appropriate, a user may activate a heating system at the access panel 24 (such as via the inputs 74), or the control circuitry 64 may automatically activate the heating system based on temperature measurements performed by the temperature sensor 90. Such heating may be desirable when the compressor 20 is deployed in cold weather, such as in icy, rainy, and/or snowy conditions, when the possibility that ice has built up or will build up is likely. In another embodiment, cycling the valve 86 may provide heat to reduce the buildup of ice, such that the heating element 88 may be excluded.

The regulator 70 is configured to regulate the pressure within the compressor 20 via the outlet pressure line 80 and the control pressure line 84. Thus, as the electronic control 64 performs the actions described herein, an operator can visualize the current pressure provided by the compressor 20 via the pressure gauge 72, and then adjust the pressure up or down via the regulator 70 if desired. An operator may desire to decrease the pressure generated by the compressor 20 to enable the generator 22 (FIG. 1) to draw more mechanical power from the engine 12 to increase electrical power, for example, to increase the electrical power supplied to a plasma cutter. An operator may use the gauge 72 and the regulator 70 to ensure the pressure generated by the compressor 20 stays within the operating pressure range of the plasma cutter, while at the same time reducing the pressure to provide more power to the plasma cutter. Additionally, an operator may control air flow rate by adjusting the speed of the engine 12 using the control circuitry 64 described above. An operator may also control the speed of the engine 12 by adjusting the user inputs 74 on the control panel 24. Thus, by controlling both air pressure through the regulator 70 and engine speed/air flow through the user inputs 74, an operator may select the air requirements suitable for a plasma cutter, air tool, or other device connected to the system 10 in addition to performing valve cycling.

Pressure gauge 72 may be any type of pressure gauge having a measurement range suitable for the range of pressures generated by the air compressor 20. The illustrated pressure gauge 72 includes an analog face having marks corresponding to pressure values that may be any desired unit of measurement, such as PSI, atm, bar, Pascals, mmHg, etc. The face of the pressure gauge 72 may include designated regions showing the operating pressure ranges of different air-operated devices connected to the air compressor 20 as well as the designated pressures for performing valve cycling (e.g., at pressure set points). Indeed, in one embodiment, the gauge 72 may also provide a form of control, such that adjusting valve cycling pressure set points on the gauge 72 adjusts the pressures at which the valve 82 is cycled. Additionally, the designated regions may show a maximum or critical pressure beyond which the air compressor 20 may not be safely operated. The system 50 also may include an automatic shutoff control to disengage the compressor 20 from the engine 12, or shutoff the engine 12, or release pressure from the compressor 20, or a combination thereof, if a critical pressure is reached or exceeded as indicated on the gauge 72, for example due to contaminant buildup within the compressor 20.

As discussed above, the air compressor 20 has a range of operating pressures depending on the size of the components of the compressor, such as the case, inlet and outlet valves and the rotary screw mechanism. The top end of this operating pressure range indicates a maximum or critical pressure that the operating pressure of the compressor 20 that may increase wear or cause damage to the compressor 20 or other components of the system 10. For example, in one embodiment, the compressor 20 may have a maximum or critical pressure of 200 PSI. If the operating pressure of the air compressor 20 exceeds this pressure, for example due to a buildup of contaminants, then internal components of the air compressor 20, the housing of such internal components, or the air compressor 20 may be damaged. In addition, internal oil pressures may also reach a critically high level, resulting in oil blowback and damage to internal seals.

To prevent damage to the compressor 20 or any other part of the service pack 14 or vehicle 10, the illustrated air compressor 20 includes a valve 92 that is configured to open if the pressure of the compressor 20 exceeds the maximum or critical pressure. The valve 92 provides a relief point that opens to reduce the possibility of potential damage associated with exceeding the maximum or critical pressures. Instead of a critically high pressure causing blowback through the compressor 20 or damaging internal components, the pressure will be relieved through the opening of the valve 92. In some embodiments, the valve 92 may be a pop-off valve or similar release valve capable of relieving built-up pressure.

The control system 50 is configured to address the possibility that the maximum or critical pressure of the air compressor 20 is inadvertently reached. The control system 50 may provide an automatic shutoff function to shutoff the compressor 20 before or if the maximum or critical pressure is reached. The automatic shutoff function automatically disengages the clutch 62 coupling the air compressor 20 to the compressor pulley 58 and the stub shaft 52 of the engine 12, thereby turning off the compressor 20 and allowing the pressure to decrease. The electronic control 64 may activate the automatic shutoff function, for example upon receiving a pressure signal 94, which may be indicative of shutdown, from the pressure gauge 72. The pressure gauge 72 sends the shutdown signal to the electronic control 64 if the pressure gauge 72 detects a pressure near or at the maximum or critical pressure. For example, to ensure the valve 92 does not open, the shutdown signal may be configured to be sent when the pressure gauge 72 detects a pressure slightly below the maximum or critical pressure. Once the electronic control 64 receives the shutdown signal from the pressure gauge 72, the electronic control 64 disengages the electronic clutch 62 and shuts down the air compressor 20. Alternatively, the electronic control 64 may receive pressure values from a pressure sensor located elsewhere in the system and make the determination to shutdown the compressor 20 based on those values, instead of receiving a shutdown signal from the pressure gauge 72. Alternatively, the pressure level sensed by the gauge 72 may be used to initiate an automatic shutdown of the engine 12, automatic release of pressure via the valve 92, or automatic adjustment of the inlet valve 82 or main control valve 86, or a combination thereof, to reduce pressure in response to a critical pressure. In other embodiments, the automatic shutdown may be initiated by a pressure switch located elsewhere in the system.

As the air compressor 20 may undergo periods of little to no use, it may be useful for the operator to know how long the compressor has been turned off or inactive. In knowing how long the compressor 20 has been inactive, in lieu of the electronic control 64, a user may manually activate a valve cycling routine to dislodge any possible buildup of ice or other contaminant. Advantageously, the control system 50 provides for storage of the hours of operation and periods of inactivity of the air compressor 20. The memory 66 of the electronic control 64 may be configured to store the duration of operation and/or inactivity of the compressor 20, a predetermined service and/or maintenance time interval, temperatures sensed within the period of inactivity, pressure fluctuations during the period of inactivity, and the likelihood of contaminant buildup as determined by the processor 68. The duration of inactivity of the compressor 20 may be determined from the engagement of the electronic clutch 62 (or lack thereof). The electronic control 64 monitors the duration of the engagement or lack thereof of the electronic clutch 62 and stores that value as the duration of operation/inactivity of the compressor 20. The duration may be stored as any unit of time, such as hours, minutes, etc, and the processor 68 may include functions for converting between different units of time. Predetermined likelihoods of ice or contaminant buildup, such as typical dew or freezing points, may be stored in the memory 66 during programming of the electronic control 64. The processor 68 may compare the stored duration of inactivity of and the temperatures and/or pressure fluctuations sensed within the compressor 20 to the typical conditions for ice or contaminant buildup and calculate the likelihood that a contaminant (e.g., ice) is present within the compressor 20.

In automatic operation, based on the determination, the processor 68 may execute one or more algorithms stored on the memory 66 that is capable of performing the valve cycling tasks. The display device 76 may display the stored duration of inactivity of the compressor 20 and the predetermined likelihood of contaminant buildup. Additionally, the user's input (via input 74) of preferred conditions for automatic start of the valve cycling processes and/or the preferred conditions for notification for manual activation of the valve cycling sequence may be displayed on the display device 76. For example, in one embodiment, the user input 74 may be a knob that provides selection of either the duration of inactivity of the compressor 20 or a percentage likelihood that contaminants such as ice are present. The control panel 24 also provides for resetting the user's inputs, through operation of the user input 74 and/or additional user inputs on the control panel 24. In this manner, the user may activate or deactivate automatic valve cycling processes where desirable.

Figure 3:
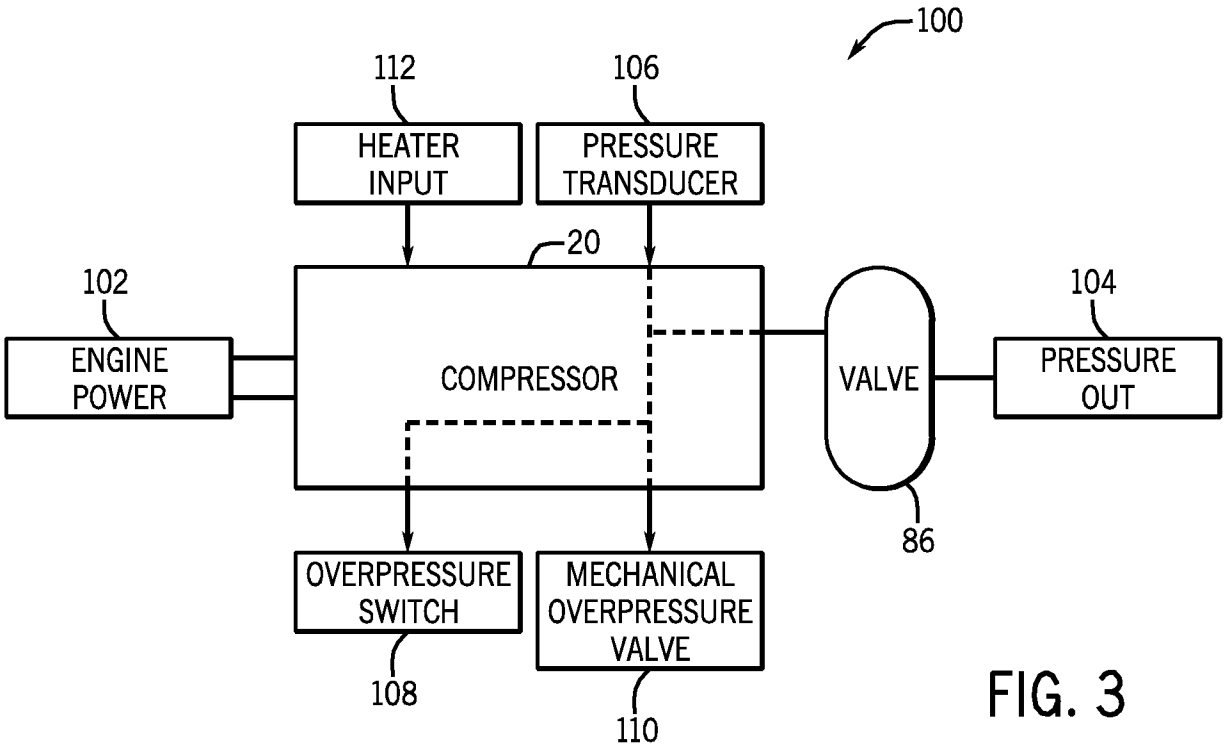
FIG. 3 is a diagrammatical representation of an embodiment of the compressor, wherein the compressor performs cycling of a main control valve to prevent and/or break up ice or debris build up in the compressor.
Figure 4:
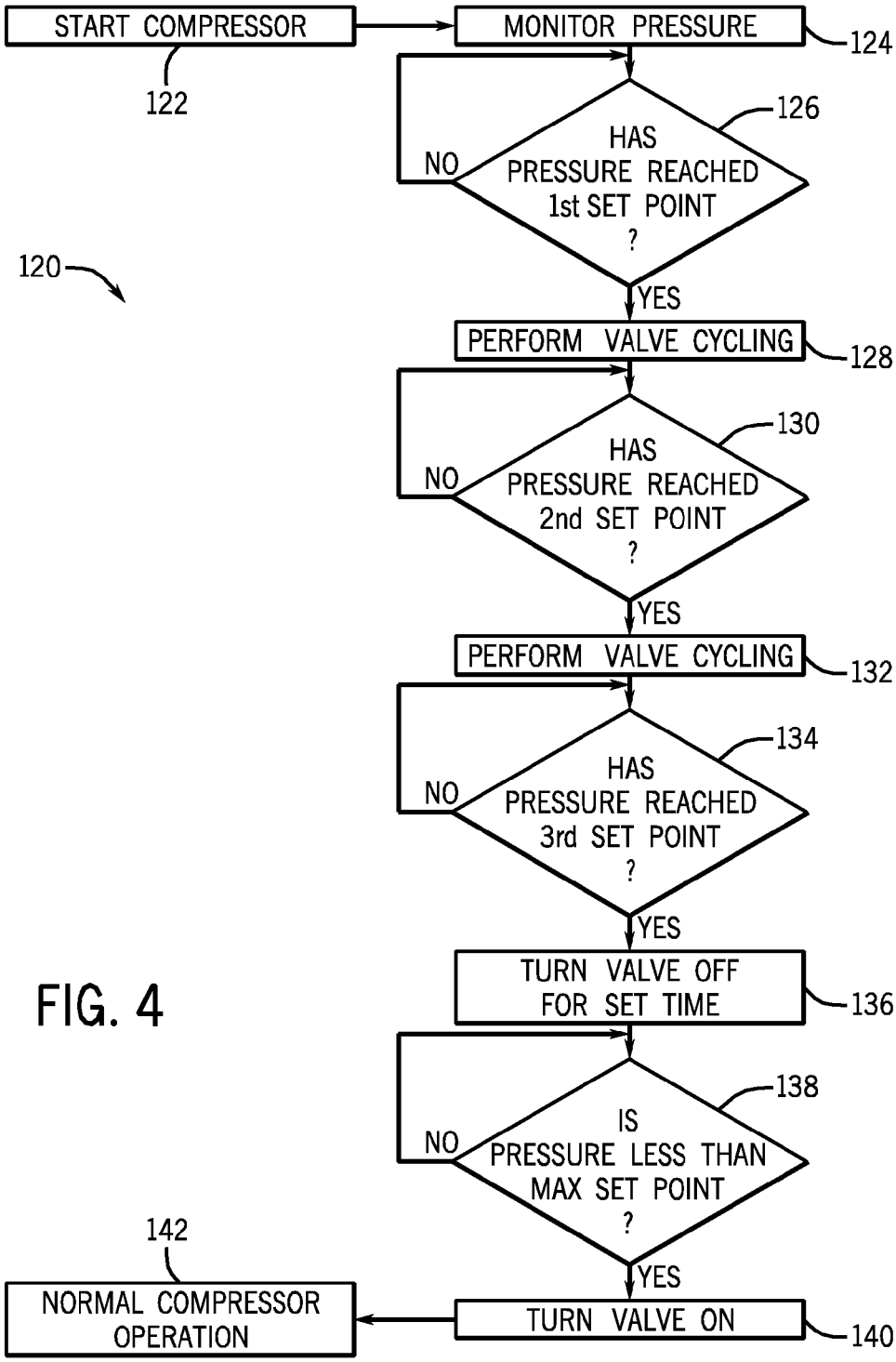
FIG. 4 is a process flow diagram of an embodiment of a method for performing cycling of a main control valve of a compressor to prevent and/or breakup ice or debris buildup.

As noted above, the present embodiments are directed towards cycling the main control valve 86 of the compressor 20 to prevent freeze up due to ice or debris buildup. While the acts described above are provided in the context of a service pack, for example a pack able to provide hydraulic power, electrical power and the like, it should be noted that the approaches described herein may be applicable to a variety of compressors. For example, the valve cycling noted above provides system 50 that includes an electronic control mechanism, which is the control circuitry 64 containing the processor 68 and memory 66. However, as illustrated in FIG. 3, the valve cycling may be performed by a compressor that is not coupled to a controller, or a controller that utilizes switches rather than discrete components capable of performing non-switching tasks. For example, rather than having algorithms capable of performing valve cycling routines as a result of one or more analyses, the compressor 20 may include a variety of switches and so forth that activate the valve 86 upon reaching respective set points.

The compressor 20 in FIG. 3 is part of a compression system 100 having engine power 102 provided to the compressor 20 to generate a pressure output 104 (i.e., in the form of pressurized gas). The system 100 also includes a pressure transducer 106 that may be a pressure sensor which senses the pressure input and output to and from the compressor 20, the inner pressure within the compressor 20, and so on. The pressure transducer 106 may be configured to generate a mechanical or electrical signal in response to the measured pressure, and provide the signal to an overpressure switch 108 and a mechanical overpressure valve 110. The overpressure switch 108 and the overpressure valve 110 may be configured to receive the pressure signal and, at a set point, such as at a certain pressure, may be configured to open the mechanical overpressure valve 110. For example, in operation, the overpressure switch 108 may receive, on a substantially constant basis, the pressure signal from the pressure transducer 106. When the overpressure switch 108 receives a signal indicative of a pressure higher than a set point value (for example a manufacturer's or a user's set point), the switch may cause the mechanical overpressure valve 110 to open.

Unfortunately, many compressors utilize oil and other lubricating agents for their internal parts. At the high pressures which cause the mechanical overpressure valve 110 to open, it is therefore likely that there may be at least some blowback that causes oil and other lubricating agents to be ejected from the compressor 20. To prevent the mechanical overpressure valve 110 (and the overpressure switch 108) from activating, the compressor 20 may cause the valve 86 to cycle at pressures lower than the pressure at which the overpressure switch 108 activates. Alternatively, a switch or controller may be present that overrides the overpressure switch 108, which prevents the mechanical overpressure valve 110 from opening. The valve cycling, as mentioned above, also causes any contaminant buildup (e.g., ice or other debris) to be loosened to avoid compressor freeze up. According to the present approaches, the valve cycling includes actuating the valve between open and closed positions. As noted above, however, such cycling may not necessarily result in the valve reaching the fully-open and/or fully-closed positions. A single valve cycle may last anywhere between approximately 0.5 and 10 seconds, or any other suitable duration as noted above. As an example, the valve 86 may be turned off for the between approximately 0.5 and 10 seconds, followed by the valve being turned on. The number of cycles may be determined by a user or manufacturer, and may include a single off-on cycle or a plurality of off-on cycles (e.g., 1 to 20, 1 to 10, or 1 to 5).

As an example of the valve cycling process, the compressor 20 may cycle the valve 86 at distinct set points, for example at one or a plurality of time points after the compressor 20 starts up. The time points may be, for example, between approximately 5 seconds and 1 minute, 1 minute and 10 minutes, 10 minutes and 30 minutes, and so forth. The set time points may be the same or different time delays relative to one another, for example, every 30 seconds, every minute, every hour, and so on. Other set points may include temperatures and/or pressures. Indeed, other set points or sensed data is also contemplated, including acoustic, vibrational, or any other data that could be indicative of an impending compressor freeze up. In embodiments where the temperature is measured (e.g., via a thermocouple or similar thermometer), the valve 86 may cycle at set temperatures, either as a result of heat generated by operation of the compressor 20 or a reduction of temperature in cold weather. It should also be noted that the valve 86 may produce a certain amount of heat during cycling, such that at least a portion of ice that may be present in the compressor 20 is melted. Additionally, a heater input 112 may be provided for heating the compressor 20 and/or valve surroundings (e.g., to melt accumulated ice).

According to the present embodiments, the valve 86 is cycled at set pressure points. In cycling at set pressure points, the valve 86 may provide an increasing amount of force on any contaminant which may be mitigating proper operation of the compressor 20 or the valve 86. As such, the pressure-activated cycling may be performed at a first pressure, at a second pressure, a third pressure, and so on, such that the set points include one or a plurality of pressure set points (e.g., 2 to 100). As an example, a first pressure set point may be between approximately 50 and 80 PSI (e.g., 50, 60, 70, 75, or 80 PSI), a second pressure set point may be between approximately 80 and 100 PSI (e.g., 80, 85, 90, 95 or 100 PSI), and a third pressure set point may be between approximately 100 and 180 PSI (e.g., 100, 110, 120, 130, 140, 150, 160, 170, or 180 PSI). Indeed, while the present valve cycling is performed at these pressures, both higher and lower pressures are contemplated herein, such as lower than approximately 50 PSI and higher than approximately 180 PSI.

In addition to the systems described above which are configured to perform valve cycling, the embodiments described herein also provide a method of operating a compressor after startup. More specifically, a method 120 is provided for preventing compressor freeze up or, alternatively, for mitigating the effect of contaminant accumulation on the operation of the compressor 20. Therefore, the method 120 begins with starting the compressor 20 (block 122), for example by a keyed ignition, a start button (for example, located on the compressor 20 or the access panel 24 of FIGS. 1-2), or similar feature. The pressure is then monitored (block 124), for example, by a pressure transducer (i.e., sensor), that is configured to provide a signal indicative of the current pressure within the compressor 20 to a controller or similar feature. The compressor 20 (e.g., the processing component 68 of control circuitry 64) may then determine whether the pressure in the compressor 20 has reached the first set point (block 126). In situations where the compressor 20 has not yet reached the first set point (e.g., first temperature, time, or pressure), the method 120 cycles back to monitoring. In situations where the first set point has been reached, the method 120 progresses to performing valve cycling (block 128) as described above.

After the initial valve cycling is performed (block 128), which may include one or a plurality of off-on cycles, the method 120 then progresses to another determination as to whether the compressor 20 has reached the second set point (block 130). In situations where the compressor 20 has not reached the second set point, the method 120 cycles back to monitoring. However, in situations where the compressor 20 has indeed reached the second set point, the compressor 20 may then perform a second set of valve cycling (block 132).

After the second set of valve cycling is performed (block 132), which may include one or a plurality of off-on cycles as noted above, the method 120 then progresses to another determination as to whether the compressor 20 has reached the third set point (block 134). In situations where the compressor 20 has not reached the third set point, the method 120 cycles back to monitoring. However, in situations where the compressor 20 has indeed reached the third set point, the compressor 20 may then open the valve 86 for a designated time (e.g., between approximately 0.5 and 10 seconds) (block 136). After the designated time has elapsed, the method 120 then progresses to a determination as to whether the pressure within the compressor 20 is less than a maximum set point (block 138). In situations where the pressure is greater than the maximum set point (e.g., not less than), the method 120 provides for the compressor 20 to keep the valve 86 off for the set time again, followed by making the same determination until the pressure is below the maximum set point. In this way, the method 120 prevents the overpressure switch 108 and the mechanical overpressure valve 110 of system 100 from activating while the valve cycling routine is in play. After a determination has been made that the pressure within the compressor 20 is below the maximum set point, the valve 86 may be turned on (block 140). Thereafter, the compressor 20 may carry out normal operation (block 142).

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a compressor, comprising:

a compression device configured to increase a pressure of a gas;

an outlet flow path configured to flow the gas out of the compressor;

a valve disposed along the outlet flow path and configured to control flow of the gas from the compression device; and a controller comprising a tangible, non-transitory storage medium storing one or more algorithms executable by a processor to cause the controller to cycle the valve a plurality of times when an input is received that a set point indicative of contaminant buildup in the compressor has been reached;

wherein the valve is configured to apply a force to dislodge the contaminant buildup when cycled the plurality of times.

2. The system of claim 1, wherein the one or more algorithms are executable by the processor to cause the controller to cycle the valve to reduce buildup of ice in the compressor.

3. The system of claim 1, wherein the input comprises sensor feedback.

4. The system of claim 3, wherein the compressor comprises a pressure sensor configured to obtain data indicative of the pressure of the gas, and the one or more algorithms are executable by the processor to cause the controller to cycle the valve upon receiving the sensor feedback from the pressure sensor indicative of a first pressure level.

5. The system of claim 4, wherein the one or more algorithms are executable by the processor to cause the controller to cycle the valve upon receiving the sensor feedback from the pressure sensor indicative of a second pressure level, and the second pressure level is greater than the first pressure level.

6. The system of claim 5, wherein the one or more algorithms are executable by the processor to cause the controller to cycle the valve upon receiving the sensor feedback from the pressure sensor indicative of a third pressure level, and the third pressure level is greater than the second pressure level.

7. The system of claim 3, wherein the compressor comprises a temperature sensor configured to obtain data indicative of a temperature in the compressor, and the one or more algorithms are executable by the processor to cause the controller to cycle the valve upon receiving the sensor feedback from the temperature sensor indicative of a first temperature level.

8. The system of claim 7, wherein the one or more algorithms are executable by the processor to cause the controller to cycle the valve at predetermined time increments after reaching the first temperature level.

9. The system of claim 1, comprising an engine drivingly coupled to the compressor and an electrical generator.

10. The system of claim 9, wherein the engine is drivingly coupled to a hydraulic pump.

11. A system, comprising:

a compressor, comprising:

a compression device configured to increase a pressure of a gas;

a valve configured to control whether the gas flows from the compression device; and a controller comprising a tangible, non-transitory storage medium storing one or more algorithms executable by a processor to cause the controller to cycle the valve between an open position and a closed position a plurality of times at every instance of each of a plurality of set points after startup of the compressor to reduce buildup of ice in the compressor by applying a force against the ice to dislodge the ice.

12. The system of claim 11, wherein the plurality of set points comprises a plurality of pressure levels of the gas.

13. The system of claim 11, wherein the plurality of set points comprise a plurality of temperatures in the compressor.

14. The system of claim 11, wherein the plurality of set points comprise a plurality of times after startup.

15. A method, comprising:

cycling a valve of a compressor a plurality of times upon receiving feedback that one set point of a plurality of set points has been reached after startup of the compressor to reduce buildup of ice in the compressor, wherein the cycling of the valve causes the valve to apply a force against the ice to dislodge the ice.

16. The method of claim 15, comprising monitoring at least one parameter of the compressor to obtain the feedback, and cycling the valve in response to the feedback to reduce buildup of ice in the compressor.

17. The method of claim 15, wherein the plurality of set points comprise a plurality of pressure levels of the gas, a plurality of temperatures in the compressor, or a plurality of times after startup, or a combination thereof.

18. The system of claim 1, wherein the controller cycles the valve the plurality of times by repeatedly actuating the valve between open and closed positions.

19. The system of claim 11, wherein the compressor comprises an outlet flow path configured to flow the gas out of the compressor, and the valve is disposed along the outlet flow path such that the valve determines whether the gas flows out of the compressor.

* * * * *